United States Patent [19]

Tashiro et al.

[11] Patent Number: 4,935,097

[45] Date of Patent: Jun. 19, 1990

[54] PROCESS FOR PRODUCING PAPER

[75] Inventors: Naoya Tashiro, Tokyo; Hiroshi Uehara, Noda, both of Japan

[73] Assignee: Mitsubishi Paper Mills, Ltd., Tokyo, Japan

[21] Appl. No.: 232,218

[22] Filed: Aug. 15, 1988

Related U.S. Application Data

[63] Continuation-in-part of Ser. No. 930,408, filed as PCT JP86/00045 on Feb. 5, 1986, published as WO86/04622 on Aug. 14, 1986, abandoned.

[30] Foreign Application Priority Data

Feb. 8, 1985 [JP] Japan ..... 60-23055

[51] Int. Cl.[5] ..... D21H 1/34; D21H 3/02

[52] U.S. Cl. ..... 162/135; 162/136; 162/158; 162/164.3; 162/164.6; 162/168.1; 162/168.3; 162/169; 162/174; 162/175; 162/205; 162/206; 427/326; 427/361; 427/364; 427/382; 427/391; 427/395

[58] Field of Search ..... 162/135, 158, 204, 206, 162/207, DIG. 6, 136, 164.3, 164.6, 168.1, 168.3, 169, 174, 175, 205; 100/74, 92, 161; 427/326, 361, 364, 382, 391, 395

[56] References Cited

U.S. PATENT DOCUMENTS

| | | | |
|---|---|---|---|
| 2,378,113 | 6/1945 | Van de Carr | 162/206 |
| 3,124,504 | 3/1964 | Mahoney et al. | 162/206 |
| 3,647,619 | 3/1972 | Mack et al. | 162/206 |
| 3,948,721 | 4/1976 | Winheim | 162/207 |

FOREIGN PATENT DOCUMENTS

| | | | |
|---|---|---|---|
| 1217777 | 12/1970 | United Kingdom | 162/135 |

OTHER PUBLICATIONS

Casey, *Pulp and Paper*, vol. III (1981), pp. 1895–1903.

Calkin, *Modern Pulp and Papermaking*, 3rd ed., (1957), pp. 312, 313.

*Primary Examiner*—Peter Chin

*Attorney, Agent, or Firm*—Cushman, Darby and Cushman

[57] ABSTRACT

A paper having an absolute dry moisture content (moisture content in absolute dry condition) of 1.8–7% is subjected to a heat calendering treatment at a temperature of 150°–300° C. under a linear pressure of 40 kg/cm or above to provide a paper which has both satisfactory surface smoothness and rigidity (stiffness) and is suited for use as a photographic support.

19 Claims, No Drawings

PROCESS FOR PRODUCING PAPER

This is a continuation of application Ser. No. 930,408, filed as PCT JP86/00045 on Feb. 5, 1986, published as WO86/04622 on Aug. 14, 1986, now abandoned.

TECHNICAL FIELD

This invention relates to a process for producing paper, more particularly to a process for producing paper which is satisfactory in both surface smoothness and rigidity (stiffness) and suited for use as a photographic support although the use of the paper is not limited thereto.

BACKGROUND ART

Among the means for bettering the surface smoothness of paper are proper selection of pulp material, calendering of paper, increase of pressing force and increase of paper density. For enhancing the rigidity (stiffness) of paper, means are known such as properly selecting the pulp material, making the paper bulky, etc. However, the treatment for bettering the surface smoothness of paper and the treatment for enhancing the rigidity (stiffness) of paper are incompatible with each other, and thus it has been difficult to satisfy both requirements at the same time.

DISCLOSURE OF THE INVENTION

Said problem of the prior art was solved by a paper producing process characterized in that a paper having a moisture content of 1.8–7% in absolute dry condition is subjected to a heat calendering treatment under the conditions of 150° –300° C. and 40 kg/cm or above in linear pressure.

Thus, the present invention provides a process for producing paper characterized in that a paper having a moisture content of 1.8–7% in absolute dry condition is subjected to a heat calendering treatment under the conditions of 150°–300° C. and 40 kg/cm or above in linear pressure.

MODE FOR CARRYING OUT THE INVENTION

The paper used in this invention can be one which has been made by using whatever available type of pulp and which also may contain chemical additives such as sizing agent, fluorescent agent, etc., but it is preferred to use a paper obtained from, for example, the following method.

That is, a mixed pulp consisting of LBKP, LBSP and NBSP mixed in predetermined ratios is added with additives such as alkyl ketene diameter, polyacrylamide, polyamide epichlorohydrin, starch, fluorescent agent, etc., to form a paper web of a predetermined basis weight, and this paper web is dried and then further added with a modified polyvinyl alcohol as surface sizing agent, an inorganic electrolyte such as common salt and a fluorescent agent before undergoing the heat calendering treatment. said surface sizing treatment may be conducted after the heat calendering treatment as described later.

The reason for defining the moisture content in absolute dry condition (hereinafter referred to as absolute dry moisture content) to 1.8–7% is based on the fact that if said moisture content is less than 1.8%, no satisfactory effect of the heat calendering treatment is provided resulting in a poor surface quality of the produced paper, while if said moisture content exceeds 7%, water tends to scatter in the heat calendering treatment to cause a poor paper surface quality. Such trouble will not occur when said moisture content is 1.8–7%.

The reason for defining the heat calendering temperature to 150°–300° C. in the present invention is that if said temperature is below 150° C., the unevenness of the paper surface remains large as in the case of the conventional calendering treatment and the desired smooth surface can not be obtained, while if said temperature exceeds 300° C., not only the surface smoothness is worsened but there also arises the problem of paper parching. These problems will not occur and a smooth surface can be obtained if said temperature is in the range of 150°–300° C. Heating can be accomplished by using such means as electric heating, electromagnetic induction and the like.

The reason for defining the linear pressure to 40 kg/cm or above in the heat calendering treatment in the present invention is that if said liner pressure is less than 40 kg/cm, the desired surface smoothness can not be obtained.

In the present invention, the heat calendering treatment may be carried out either before or after the surface sizing treatment (conducted by using, for example, a modified polyvinyl alcohol solution).

As apparent from the Examples given later, an especially desirable result can be obtained when (i) the absolute dry moisture content of the paper to be subjected to the heat calendering treatment is 2.5–5%, (ii) the air permeability of the paper to be heat calendered is 300 sec or less, (iii) the heat calendering temperature is 160° –270° C., and (iv) the linear pressure in the heat calendering treatment is 60 kg/cm or above, etc.

According to the present invention, water may be added after the heat calendering to adjust the final moisture content. Such addition of water can be effected by using an aqueous solution containing one or more of surface strengthing agent(s) (such as polyvinyl alcohol, starch, casein, gelatin, SBR, NBR, polyacrylamide, etc.), dye, fluorescent agent, antistatic agent, anti-fogging agent, etc., according to the object and prupose of use. By such addition of water, the final moisture content is adjusted to, for instance, 6% or above.

Said supply of water to adjust final moisture constant to, for instance, 6% or above and the addition of various additives to said aqueous solution are preferably made in case the paper obtained according to this invention is used as a photographic support described below.

The paper obtained according to this invention is especially suited for use as a photographic support (paper support and resin-coated paper support) which must satisfy both required levels of rigidity (stiffness) and surface smoothness. For instance, the paper obtained according to this process can be used directly as a photographic paper support just like a white-and-black copying paper or DTR copying paper, and can be also used indirectly as a photographic paper support just like ordinary white-and-black printing paper, by coating it with an inorganic pigment such as baryta. Further, it can be used as a photographic resin-coated paper support by coating said paper with a polyolefin resin such as polyethylene by, for example, extrusion coating method like ordinary color printing paper. The copying paper and printing paper using the paper obtained according to this process can satisfy rigidity (stiffness) and also has fine smoothness.

Regarding the rigidity, in case the paper obtained according to this invention is used as a photographic paper support, such support has a Taber rigidity of 11 g-cm or above when the thickness is 165 μm and 13 g-cm or above when the thickness is 175 μ. Also, the photographic resin-coated paper support made by providing a resin coating layer on both sides of the paper obtained according to this invention has a Taber rigidity of 16.5 g-cm or above when the base paper thickness is 165 μ and the total thickness is 220 μ and a Taber rigidity of 19 g-cm or above when the base paper thickness is 175 μ and the total thickness is 230 μ.

The paper obtained according to this invention is small in surface unevenness and also has fine surface smoothness, so that when it is used as a photographic support and an emulsion is applied thereto, there hardly occurs the so-called Emulsion mottle (a partial disturbance of the layers in the multi-layer structure which occurs when a photographic emulsion is applied to the photographic support). Also, swelling of the emulsion layer after the wet photographic processing is minimized, and there seldom takes place scratching or exfoliation of the emulsion layer.

EXAMPLES

The present invention will hereinafter be described in further detail by way of examples thereof, but it should be understood that the present invention is not limited to these examples.

EXAMPLES 1-5 AND COMPARATIVE EXAMPLES 1-2

A pulp prepared by mixing 20 parts by weight of NBSP, 50 parts by weight of LBSP and 30 parts by weight of LBKP was beaten to a freeness of 300 ml, and this pulp slurry was added with Aquapel (made by Dick Hercules Inc.) mainly composed of an alkyl ketene diamer as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 g/m$^2$, and this paper web was dried. The dried paper web was further subjected to a surface sizing treatment by using a modified Poval solution as surface sizing agent and dried to obtain a paper having an absolute dry moisture content of 5%, an air permeability of 60 seconds and an internal bond strength of 2.3 kg-cm. The thus prepared samples of paper were heat calendered at temperatures of 120° C., 145° C., 150° C., 160° C., 200° C, 270° C. and 300° C., respectively, under a linear pressure of 150 kg/cm. The test results of the obtained papers are shown in Table 1.

TABLE 1

| | Heat calendering temperature | Flatness (1) |
|---|---|---|
| Comp. Example 1 | 120° C. | 4.5 |
| Example 2 | 145 | 4.25 |
| Example 1 | 150 | 4.0 |
| Example 2 | 160 | 4.0 |
| Example 3 | 200 | 3.75 |
| Example 4 | 270 | 3.5 |

TABLE 1-continued

| | Heat calendering temperature | Flatness (1) |
|---|---|---|
| Example 5 | 300 | 4.0 |

Note (1): The flatness was evaluated by observing and grading the degree of surface unevenness of the paper with the naked eye. The smaller the numerical value, the less is the surface unevenness of the paper and the smoother looks the paper surface. When the grade is greater than 4, the surface unevenness of the paper is too large and the paper surface can not be said smooth.

As seen from Table 1, if the heat calendering temperature is below 150° C., the surface unevenness of the paper is large and no smooth surface can be obtained. Also, when the heat calendering temperature exceeds 300° C., the flatness is worsened.

On the other hand, when the heat calendering temperature is 150°-300° C., the grade of flatness can be kept below 4, allowing obtainment of a smooth paper with small surface unevenness.

EXAMPLES 6-10 AND COMPARATIVE EXAMPLES 3-4

A pulp composed of 20 parts by weight of NBSP, 50 parts by weight of LBSP and 30 parts by weight of LBKP was beaten to a freeness of 300 ml. This pulp slurry was added with Aquapel (made by Dick Hercules Inc.) mainly composed of an alkyl ketene diameter as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 g/m$^2$. This paper web was dried to obtain a paper having an absolute dry moisture content of 2.5%, an air permeability of 60 sec. and an internal bond strength of 2.3 kg-cm. The thus prepared paper samples were subjected to heat calendering at temperatures of 120° C., 145° C., 150° C., 160° C., 200° C., 270° C. and 300° C., respectively, under a linear pressure of 150 kg/cm and then subjected to surface sizing by using a modified Poval solution as surface sizing agent, followed by drying and an additional calendering treatment at a temperature of 30° C. under a linear pressure of 70 kg/cm to make the final moisture content 8.5%. The test results of the obtained papers are shown in Table 2.

TABLE 2

| | Heat calendering temperature | Flatness |
|---|---|---|
| Comp. Example 3 | 120° C. | 4.5 |
| Comp. Example 4 | 145 | 4.25 |
| Example 6 | 145 | 4.25 |
| Example 7 | 150 | 4.0 |
| Example 8 | 160 | 4.0 |
| Example 9 | 200 | 3.5 |
| Example 10 | 270 | 3.5 |
| | 300 | 4.0 |

Examples 6-10 and Comparative Examples 3-4 shown in Table 2 are different from Examples 1-5 and Comparative Examples 1-2 shown in Table 1 in that surface sizing was carried out after heat calendering in the former, while surface sizing was carried out before heat calendering in the latter, but the substantially same results were obtained.

EXAMPLES 11-14 AND COMPARATIVE EXAMPLES 5-6

Papers were prepared by using the same pulp and the same chemical blend as used in Examples 1-5 and Comparative Examples 1-2, and their absolute dry moisture content before heat calendering was adjusted to 1.5%, 1.8%, 2%, 2.5%, 5%, 7% and 9%, respectively, and then these papers were subjected to heat calendering at a temperature of 270° C. under a linear pressure of 150 kg/cm. The test results of the obtained papers are shown in Table 3 along with the test results of Example 4. Each paper had an internal bond strength of 2.3 kg-cm and an air permeability of 60 sec.

TABLE 3

| | Absolute dry moisture content before heat calendering | Flatness |
|---|---|---|
| Comp. Example 5 | 1.5% | 4.25 |
| Example 11 | 1.8 | 4.0 |
| Example 12 | 2 | 4.0 |
| Example 13 | 2.5 | 3.25 |
| Example 4 | 5 | 3.5 |
| Example 14 | 7 | 4.0 |
| Comp. Example 6 | 9 | 4.75 |

As seen from Table 3, a smooth paper with small surface unevenness can be obtained when the absolute dry moisture content (moisture content in absolute dry condition) before heat calendering is 1.8-7%, especially 2.5-5%.

EXAMPLES 15-18 AND COMPARATIVE EXAMPLES 7-8

Papers were prepared with the same pulp and the same chemical blend as used in Examples 6-10 and Comparative Examples 3-4, with their absolute dry moisture content before heat calendering being adjusted to 1.5%, 1.8%, 2%, 2.5%, 5%, 7% and 9%, respectively. These papers were subjected to heat calendering at a temperature of 270° C. under a linear pressure of 150 kg/cm before surface sizing and then subjected to the same treatment as in Examples 6-10 and Comparative Examples 3-4 to adjust the final moisture content to 8.5%. The test results of the obtained papers are shown in Table 4 along with the test results of Example 9. The air permeability and internal bond strength of said paper before heat calendering were 60 sec. and 2.3 kg-cm, respectively.

TABLE 4

| | Absolute dry moisture content before heat calendering | Flatness |
|---|---|---|
| Comp. Example 7 | 1.5% | 4.5 |
| Example 15 | 1.8 | 4.0 |
| Example 16 | 2 | 4.0 |
| Example 9 | 2.5 | 3.5 |
| Example 17 | 5 | 3.5 |
| Example 18 | 7 | 4.0 |
| Comp. Example 8 | 9 | 4.75 |

The examples and Comparative Examples shown in Table 4 are different from the Examples and Comparative Examples shown in Table 3 in the order of practice of surface sizing and heat calendering, but the substantially same results were obtained.

EXAMPLES 19-21 AND COMPARATIVE EXAMPLE 9

Papers prepared by using the same pulp and the same chemical blend as in Examples 1-5 and Comparative Examples 1-2 and adjusted to have a absolute dry moisture content of 5% before heat calendering, an air permeability of 60 sec. and an internal bond strength of 2.3 kg-cm were subjected to heat calendering at a temperature of 270° C. under linear pressures of 10 kg/cm, 40 kg/cm, 60 kg/cm and 80 kg/cm, respectively. The test results of the obtained papers are shown in Table 5.

TABLE 5

| | Linear pressure of heat calendering | Flatness |
|---|---|---|
| Comp. Example 9 | 10 kg/cm | 5.0 |
| Example 19 | 40 | 4.0 |
| Example 20 | 60 | 3.75 |
| Example 21 | 80 | 3.75 |

As seen from Table 5, a good result can be obtained when the linear pressure of heat calendering is 40 kg/cm or above, especially 60 kg/cm or above.

EXAMPLES 22-24 AND COMPARATIVE EXAMPLE 10

Papers prepared by using the same pulp with the same chemical blend as in Examples 6-10 and Comparative Examples 3-4 and adjusted to have absolute dry moisture content of 5% before heat calendering, an air permeability of 60 sec. and an internal bond strength of 2.3 kg-cm were subjected to heat calendering at a temperature of 270° C. under linear pressures of 10 kg/cm, 40 kg/cm, 60 kg/cm and 80 kg/cm, respectively, before conducing surface sizing and then subjected to the same treatment as in Examples 6-10 and Comparative Examples 3-4 to make the final moisture content 8.5%. The test results of the obtained papers are shown in Table 6.

TABLE 6

| | Linear pressure of heat calendering | Flatness |
|---|---|---|
| Comp. Example 10 | 10 kg/cm | 5.0 |
| Example 22 | 40 | 4.0 |
| Example 23 | 60 | 3.75 |
| Example 24 | 80 | 3.75 |

The examples and comparative Example of Table 6 are different from the Examples and Comparative Example of Table 5 in the order of practice of surface sizing and heat calendering, but the same results were obtained.

EXAMPLE 25

A pulp comprising 20 parts by weight of NBSP, 50 parts by weight of LBSP and 30 parts by weight of LBKP was beaten to a freeness of 300 ml. This pulp slurry was added with Aquapel (made by Dick Hercules Inc.) mainly composed of an alkyl ketene diameter as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 g/m$^2$, and this paper web was dried to obtain a paper having an absolute dry moisture content of 2.5%, an air permeability of 350 sec. and an internal bond strength of 2.3 kg-cm. This paper was heat calendered at a temperature of 270° C. under a linear pressure of 150 kg/cm and then subjected to surface sizing by using a modified Poval solution as surface sizing agent, followed by drying and additional calendering at a temperature of 30° C. under a linear pressure of 70 kg/cm to adjust the final moisture content to 8.5%. The test results of the obtained paper are shown in Table 7 together with the test results of the paper of Example 9 obtained in the same way as Example 25 except that the air permeability of the paper was adjusted to 60 sec.

TABLE 7

| | Air permeability | Flatness |
|---|---|---|
| Example 9 | 60 sec | 3.5 |
| Example 25 | 350 | 4.0 |

EXAMPLE 26 AND COMPARATIVE EXAMPLE 11

A pulp comprising 100 parts by weight of LBKP was beaten to a freeness of 300 ml, and this pulp slurry was added with Aquapel (made by Dick Hercules Inc.) mainly composed of an alkyl ketene diameter as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 g/m$^2$. This paper web was dried to obtain a paper having an absolute dry moisture content of 2.5%, an air permeability of 45 sec. and an internal bond strength of 2.0 kg-cm. The thus prepared papers were heat calendered at temperatures of 120° C. and 270° C., respectively, under a linear pressure of 150 kg/cm and then subjected to surface sizing by using a modified Poval solution as surface sizing agent, followed by drying and additional calendering at 30° C. under a linear pressure of 70 kg/cm to produce papers having a final moisture content of 8.5%.

Further, the back side of each of these papers was subjected to a corona discharge treatment and then coated with a mixture of a high-density polyethylene (density: 0.968, Melt Index (MI): 7) and a low-density polyethylene (density: 0.918, MI: 5) (mixing ratio =1/1) to a thickness of 30 μ by using an extrusion melt coater.

Then the opposite side of each paper was similarly subjected to a corona discharge treatment and coated with a low-density polyethylene containing 9% of anatase type titanium oxide (said polyethylene before addition of pigment having a density of 0.918 and a melt index of 5) to a thickness of 25 μ to produce a photographic support. The surface of this photographic support was further subjected to a corona discharge treatment and then coated with a blue-sensitive silver chlorobromide gelatin emulsion layer containing a yellow coupler, an intermediate layer, a green-sensitive silver chlorobromide gelatin emulsion layer containing a magenta coupler, an ultraviolet absorbing layer containing an ultraviolet absorber, a red-sensitive silver chlorobromide gelatin emulsion layer containing a cyan coupler and its protective layer in that order from the support by an extrusion system and dried to prepare a multilayer silver halide color photographic printing paper. The coating speed in this process was 200 m/min, and the thickness of the emulsion layer after drying was 10 μ.

The test results are shown in Table 8.

TABLE 8

| | Heat calendering temperature | Emulsion(2) mottle |
|---|---|---|
| Comp. Example 11 | 120° C. | X̸ |
| Example 26 | 270 | ○ |

Note (2): "Emulsion mottle" means the partial disturbance of the layers in the multi-layer structure which occurs when the photographic emulsion is applied to the support. The degree of such emulsion mottle is here expressed on a 5-grade system, the respective grades being represented by ○, ◐, △, X̸ and X, from the best to the worst. ○ indicates no emulsion mottle and hence the best, X being the worst.

EXAMPLES 27–28

A pulp prepared by blending 20 parts by weight of NBSP, 50 parts by weight of LBSP and 30 parts by weight of LBDP was beaten to a freeness of 300 ml, and this pulp slurry was added with Aquapel (made by Dick Hercules Inc.) mainly composed of an alkyl ketene diameter as sizing agent, Stargum (made by Seiko Kagaku Company) mainly composed of polyacrylamide as strengthening agent and Epinox (made by DicK Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 g/m$^2$. This paper web was dried to obtain a paper having an absolute dry moisture content of 2.5%, an air permeability of 45 sec. and an internal bond strength of 2.0 kg-cm. This paper was heat calendered at a temperature of 270° C. under a linear pressure of 150 kg/cm and then surface sized by using a modified Poval solution as surface sizing agent, followed by drying and additional calendering at 30° C. under a linear pressure of 70 kg/cm to produce papers having a final moisture content of 5% and 8%, respectively. (The moisture content was changed by dryer steam).

Further, the back side of each of these papers was subjected to a corona discharge treatment and then coated with a mixture of a high-density polyethylene (density: 0.968, MI: 7) and a low density polyethylene (density: 0.918, MI: 5) mixing ratio =1/1) to a thickness of 30 μ by using an extrusion melt coater.

Then the opposite side of the paper was subjected to a corona discharge treatment and then coated with a low-density polyethylene containing 9% of anatase type titanium oxide (said polyethylene before addition of pigment having a density of 0.918 and a melt index of 5) to a thickness of 25 μ to produce a photographic support. The surface of this photographic support was further subjected to a corona discharge treatment and then coated with a blue-sensitive silver chlorobromide gelatin emulsion layer containing a yellow coupler, an intermediate layer, a green-sensitive silver chlorobromide gelatin emulsion layer containing a magenta coupler, an ultraviolet absorbing layer containing an ultraviolet absorber, a red-sensitive silver chlorobromide gelatin emulsion layer containing a cyan coupler and its protective layer in that order from the support by an extrusion system and dried to prepare a mulit-layer silver halide color photographic printing paper.

Each of the thus obtained color printing paper samples was subjected to a heat treatment and then cut to a predetermined size. After measuring the weight of each sample, it was placed into a color processor and subjected to a color developing treatment for a period of 2 minutes and 30 seconds, a bleach-fixing treatment for a period of 3 minutes and water washing treatment for a period of one minute. Then the printing paper was drawn out in a wet state, the water droplets adhering to both sides of the paper were wiped out with a filter paper and the weight of the printing paper was measured quickly so that it remained wet to thereby determine the amount of liquid absorption into the emulsion. The results are shown in Table 9.

TABLE 9

| | Final moisture content | Amount of liquid absorption(3) |
|---|---|---|
| Example 27 | 5% | 28 g/m |
| Example 28 | 8 | 21 |

Note (3):The amount of liquid absorption was calculated from the following formula: The amount of liquid absorption ($g/m^2$) = weight of printing paper ($g/m^2$) after treatment − weight of printing paper ($g/m^2$) before treatment If the value of the amount of liquid absorption is large, the expansion of emulsion layer advances to make it liable for the surface laminate to suffer from damage, and in a bad case, the layer exfoliation may take place.

EXAMPLE 29

A pulp comprising a blend of 20 parts by weight of NBSP, 50 parts by weight of LBSP and 30 parts by weight of LBKP was beaten to a freeness of 300 ml, and this pulp slurry was added with Aqueapel (made by Dick Hercules Inc.) mainly composed of an alkyl ketene diameter as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and claculated as content in the paper web, to form a paper web having a basis weight of 180 $g/m^2$ and dried to obtain a paper having an absolute dry moisture content of 2.5%, an air permeability of 60 sec. and an internal bond strength of 2.3 kg-cm. This paper was heat calendered at a temperature of 270° C. under a linear pressure of 150 kg/cm and then subjected to surface sizing by using a modified Poval solution as surface sizing agent, followed by drying and additional calendering at 30° C. with the linear pressure adjusted to 150 kg/cm so that the final thickness would become 165 $\mu$, making the final moisture content 8.5%. The test results of the obtained paper are shown in Table 10. In Table 10 are also shown the test results of the paper of Example 9 obtained under the same conditions as in Example 29 except that the final calender linear pressure was adjusted to kg/cm so that the final thickness would become 175 $\mu$.

TABLE 10

| | Heat calendering temperature | Final calender linear pressure | Final thickness | Taber rigidity(4) | Flatness |
|---|---|---|---|---|---|
| Example 29 | 270° C. | 150 kg/cm | 175$\mu$ | 11.2 g-cm | 3.25 |
| Example 9 | 270 | 70 | 175 | 13.5 | 3.5 |

Note (4):Taber rigidity is a measure of the rigidity (stiffness) of the paper measured by a Taber tester. (For detail, refer to JIS-P-8125).

EXAMPLE 30 AND COMPARATIVE EXAMPLE 12

A pulp comprising 100 parts by weight of LBKP was beaten to a freeness of 300 ml, and this pulp slurry was added with Aquapel (made by Dick Hercules Inc.) mainly composed of an alkyl ketene diameter as sizing agent, Stargum (made by Seiko Kagaku Company) mainly composed of polyacrylamide as strengthening agent and Epinox (made by Dick Hercules Inc.) mainly composed of polyamide epichlorohydrin in amounts of 0.5% by weight, 2% by weight and 0.5% by weight, respectively, based on the pulp and calculated as content in the paper web, to form a paper web having a basis weight of 180 $g/m^2$. This paper web was dried to obtain papers having an absolute dry moisture content of 2.5%, an air permeability of 45 seconds and an internal bond strength of 2.0 kg-cm. These papers were heat calendered at temperatures of 120° C. and 270° C., respectively, under a linear pressure of 150 kg/cm and then subjected to surface sizing by using a modified Poval solution as surface sizing agent, followed by drying and additional calendering at 30° C. under a linear pressure of 150 kg/cm to produce papers having a final moisture content of 8.5%. Further, the back side of each of these papers was subjected to a corona discharge treatment and then coated with a mixture of a high-density polyethylene (density: 0.968, MI: 7) and a low-density polyethylene (density: 0:918, MI: 5) (mixing ratio =1/1) to a thickness of 30 $\mu$ by using an extrusion melt coater.

Next, the opposite side of each said paper was subjected to a corona discharge treatment and then coated with a low-density polyethylene containing 9% of anatase type titanium oxide (said polyethylene before addition of pigment having a density of 0.918 and a melt index of 5) to a thickness of 25 $\mu$ to produce a photographic support. The test results of the thus obtained photographic supports are shown in Table 12.

TABLE 12

| | Heat calendering temperature | Flatness |
|---|---|---|
| Comp. Example 12 | 120° C. | 4.5 |
| Example 30 | 270 | 3.5 |

EXAMPLE 31

A paper was produced with the same blend as used in Example 28, and this paper was calendered by adjusting the linear pressure of final calendering to 70 kg/cm so that the paper thickness would become 175 $\mu$ and both sides of the paper were coated similarly to Example 28 to produce a photographic support. The test results are shown in Table 13.

TABLE 13

| | Heat calendering temperature | Final calender linear pressure | Final thickness | Taber rigidity(4) | Flatness |
|---|---|---|---|---|---|
| Example 31 | 270° C. | 70 kg/cm | 175μ | 17.5 g-cm | 4.0 |

What is claimed is:

1. A process for producing paper comprising:

subjecting a photographic paper support which has been internally sized with alkyl ketene dimer and strengthened with a combination of polyacrylamide and polyamide epichlorohydrin resin and has an absolute dry moisture content (moisture content in absolute dry condition) of 1.8–7% to a heat calendaring treatment at a temperature of 150°–300° C. under a linear pressure of 70–130 kg/cm; and after said heat calendering treatment, introducing an aqueous solution containing one or more surface strengthening agents to adjust the final moisture content to 6% or more, said surface strengthening agent being selected from the group consisting of polyvinyl alcohol, starch, casein, gelatin, SBR, NBR and polyacrylamide.

2. The process according to claim 1, wherein the temperature of the heat calendering treatment is 150°–250° C.

3. The process according to claim 1, wherein the linear pressure of the heat calendering treatment is 60 kg/cm or above.

4. The process according to claim 1, wherein the absolute dry moisture content of the paper being subjected to the heat calendering treatment is 2.5–5%.

5. The process according to claim 1, wherein the air permeability of the paper being subjected to the heat calendering treatment is 300 seconds or less.

6. The process according to claim 1, wherein the aqueous solution contains an additional additive selected from a group consisting of dye, fluorescent agent, antistatic agent, anti-fogging agent.

7. The process according to claim 1, wherein the photographic paper support with a thickness of 165 μ has a Taber rigidity of 11 g-cm or above.

8. The process according to claim 1, wherein the photographic paper support with a thickness of 175 μhas a Tabler rigidity of 13 g-cm or above.

9. The process according to claim 1, wherein the photographic paper support is provided with a resin coating layer on one or both sides thereof.

10. The process according to claim 9, wherein the photographic resin-coated paper support with a thickness of 220 μ, made by providing a resin coating layer on both sides of a 165 μthick photographic paper support, has a Taber rigidity of 16.5 g-cm or above.

11. The process according to claim 9, wherein the photographic resin-coated paper support with a thickness of 230 μ, made by providing a resin coating layer on both sides of a 175 μthick photographic paper support, has a Taber rigidity of 19 g-cm or above.

12. The process according to claim 1, wherein the final moisture content is 6 to 8.5%.

13. The process according to claim 1, wherein the absolute dry moisture content of the paper before heat calendering is 2.5 to 5%, the temperature of the heating calendering treatment is 160° to 270° C., and the pressure of the heat calendering treatment is 60 kg/cm or more.

14. The process according to claim 13, wherein the temperature of the heat calendering treatment is 200° to 270° C.

15. The process according to claim 13, wherein the air permeability of the paper subjected to the heat calendering treatment is 300 seconds or less.

16. The process according to claim 13, wherein the final moisture content is 6 to 8.5%.

17. The process according to claim 1, wherein after the addition of aqueous solution the paper is dried and additionally calendered to adjust the final moisture content.

18. A process according to claim 1, wherein after introducing an aqueous solution containing one or more surface strengthening agents, the photographic support is dried to adjust the final moisture content to 6% or more.

19. A process according to claim 1, wherein the photographic support is subject to a cold calendaring treatment after adjusting the final moisture content to 6% or more.

* * * * *